US012799637B2

(12) United States Patent
Yoneda

(10) Patent No.: US 12,799,637 B2
(45) Date of Patent: Nov. 17, 2026

(54) HEAT-BONDABLE COMPOSITE FIBER, MANUFACTURING METHOD FOR SAME, AND NON-WOVEN FABRIC USING HEAT-BONDABLE COMPOSITE FIBER

(71) Applicants: ES Indorama Ventures Co., Ltd., Osaka (JP); ES Indorama Ventures L.P.; ES Indorama Ventures Denmark ApS, Varde (DK)

(72) Inventor: Satoshi Yoneda, Osaka (JP)

(73) Assignees: ES Indorama Ventures Co., Ltd., Osaka (JP); ES Indorama Ventures L.P., Athens, GA (US); ES Indorama Ventures Denmark ApS, Varde (DK)

( * ) Notice: Subject to any disclaimer, the term of this patent is extended or adjusted under 35 U.S.C. 154(b) by 343 days.

(21) Appl. No.: 18/022,515

(22) PCT Filed: Aug. 27, 2021

(86) PCT No.: PCT/JP2021/031561
§ 371 (c)(1),
(2) Date: Feb. 22, 2023

(87) PCT Pub. No.: WO2022/050189
PCT Pub. Date: Mar. 10, 2022

(65) Prior Publication Data

US 2023/0313420 A1 Oct. 5, 2023

(30) Foreign Application Priority Data

Sep. 1, 2020 (JP) ..... 2020-146940

(51) Int. Cl.
*D01F 8/14* (2006.01)
*D01D 5/08* (2006.01)
(Continued)

(52) U.S. Cl.
CPC ..... *D01F 8/14* (2013.01); *D01D 5/082* (2013.01); *D01D 5/34* (2013.01); *D01F 8/06* (2013.01);
(Continued)

(58) Field of Classification Search
CPC ..... D01F 8/14; D01F 8/06
See application file for complete search history.

(56) References Cited

U.S. PATENT DOCUMENTS

2009/0029165 A1* 1/2009 Goda ..... D01F 8/04 428/374
2009/0169802 A1* 7/2009 Miyamura ..... D04H 1/5412 442/329
(Continued)

FOREIGN PATENT DOCUMENTS

JP 2000336526 12/2000
JP 2007204901 8/2007
(Continued)

OTHER PUBLICATIONS

Illig Schwarzmann, Peter. (2019). Thermoforming—A Practical Guide (2nd Edition). Hanser Publishers.*
(Continued)

*Primary Examiner* — Jennifer A Gillett
(74) *Attorney, Agent, or Firm* — JCIPRNET

(57) ABSTRACT

Provided is a heat-bondable composite fiber which comprises a first component that contains a polyester-based resin and a second component that contains a polyolefin-based resin having a melting point lower than that of the polyester-based resin by 15° C. or more and which has a concentric sheath-core structure in which, in a cross section of a fiber orthogonal to the lengthwise direction of the fiber, the second component occupies the outer periphery of the fiber, wherein elongation at break is 350% or more, and the ratio of elongation at break to fineness is 80%/dtex or more.

3 Claims, 1 Drawing Sheet

(51) Int. Cl.

| | |
|---|---|
| ***D01D 5/34*** | (2006.01) |
| ***D01F 8/06*** | (2006.01) |
| ***D04H 1/4382*** | (2012.01) |

(52) U.S. Cl.
CPC ..... *D04H 1/43835* (2020.05); *D10B 2321/02* (2013.01); *D10B 2331/04* (2013.01); *D10B 2401/04* (2013.01)

(56) References Cited

U.S. PATENT DOCUMENTS

| | | | | |
|---|---|---|---|---|
| 2009/0243141 | A1* | 10/2009 | Goda | D01F 6/62 264/168 |
| 2009/0302241 | A1* | 12/2009 | Abe | A61L 31/18 250/519.1 |
| 2010/0273947 | A1* | 10/2010 | Miyauchi | D04H 1/4291 525/240 |

FOREIGN PATENT DOCUMENTS

| | | | |
|---|---|---|---|
| JP | 2008274448 | | 11/2008 |
| JP | 2013011051 | A * | 1/2013 |
| JP | 2016079551 | | 5/2016 |
| JP | 2017043853 | | 3/2017 |
| JP | 2018165416 | | 10/2018 |
| TW | I631245 | | 8/2018 |
| WO | 2017208967 | | 12/2017 |

OTHER PUBLICATIONS

Hutten, Irwin M.. (2016). Handbook of Nonwoven Filter Media (2nd Edition). Elsevier.*
English Machine Translation JP 2013011051.*
"International Search Report (Form PCT/ISA/210) of PCT/JP2021/031561", mailed on Nov. 16, 2021, with English translation thereof, pp. 1-4.

* cited by examiner

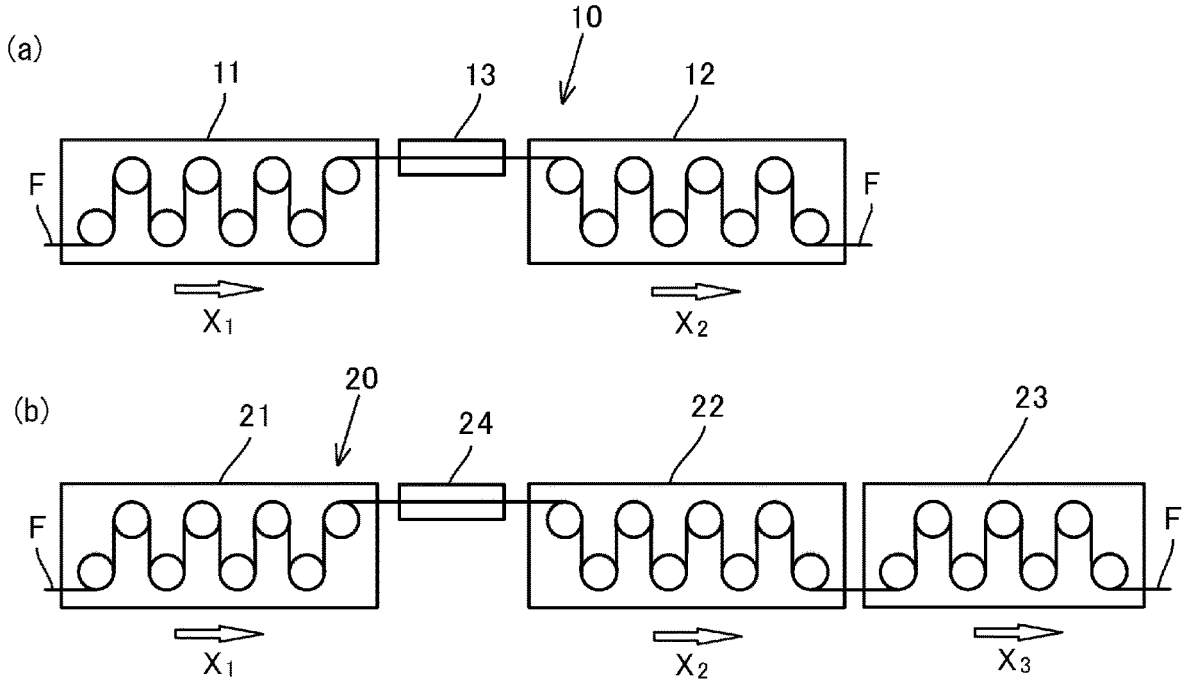
(a)
10
11
13
12
F
F
X1
X2
(b)
20
21
24
22
23
F
F
X1
X2
X3

HEAT-BONDABLE COMPOSITE FIBER, MANUFACTURING METHOD FOR SAME, AND NON-WOVEN FABRIC USING HEAT-BONDABLE COMPOSITE FIBER

CROSS-REFERENCE TO RELATED APPLICATION

This application is a 371 application of the International PCT application serial no. PCT/JP2021/031561, filed on Aug. 27, 2021, which claims the priority benefit of Japan Patent Application No. 2020-146940, filed on Sep. 1, 2020. The entirety of each of the above-mentioned patent applications is hereby incorporated by reference herein and made a part of this specification.

TECHNICAL FIELD

The present invention relates to a heat-bondable composite fiber, more specifically, to a heat-bondable composite fiber from which a non-woven fabric as follows can be obtained: the non-woven fabric is excellent in texture and excellent in shaping processability for following complex shapes or processing with high fiber deformation stress. More in detail, the present invention relates to a heat-bondable composite fiber, a manufacturing method for the same, and a non-woven fabric using the heat-bondable composite fiber, in which a non-woven fabric or the like suitable for use in absorbent articles for sanitary materials such as diapers, napkins and pads, medical sanitary materials, life-related materials, general medical materials, bedding materials, filter materials, nursing care products, and pet products and excellent in texture and shaping processability can be obtained from the heat-bondable composite fiber.

RELATED ART

Conventionally, heat-bondable composite fibers, which can be formed by heat fusion using heat energy of hot air or a heating roll, make it easy to obtain a non-woven fabric excellent in bulkiness or flexibility, and thus are widely used in sanitary materials such as diapers, napkins and pads, or daily commodities, or industrial materials such as filters. Bulkiness or flexibility is extremely important especially for the sanitary materials because the sanitary materials come into direct contact with human skin and need to quickly absorb liquids such as urine and menstrual blood. There are roughly two methods for obtaining bulkiness or flexibility of a non-woven fabric. One method is to use a bulky or flexible fiber, and the other is to perform processing (shaping processing) in which bulkiness or flexibility can be obtained in a non-woven fabric state.

For example, Patent Document 1 proposes a method in which an uneven shape is imparted to a non-woven fabric by performing gear processing being one of shaping processings on the non-woven fabric, and bulkiness and flexibility are imparted to the non-woven fabric. When such processing is performed, strong stress is applied to a fiber. If a fiber having low elongation is used at this time, the fiber may break and become fuzz on a surface of the non-woven fabric, causing deterioration in a tactile feel. Thus, a fiber having followability with respect to processing and having high elongation is required.

Patent Document 2 proposes a fiber having excellent carding processability and thermal dimensional stability while having high elongation. The fiber is obtained by subjecting an undrawn yarn of a thermo-fusible composite fiber to a fixed length heat treatment at 0.5 to 1.3 times at a temperature higher than both a glass transition point of a main crystalline thermoplastic resin of a thermo-fusible resin component and a glass transition point of a fiber-forming resin component, followed by a heat treatment under no tension at a temperature 5° C. or more higher than a temperature of the fixed length heat treatment. However, since such a fiber has a small draw magnification, there is a problem that the fineness may be increased, and a non-woven fabric having poor texture may be obtained.

PRIOR-ART DOCUMENTS

Patent Documents

Patent Document 1: Japanese Patent Laid-open No. 2017-043853

Patent Document 2: Japanese Patent Laid-open No. 2007-204901

SUMMARY OF THE INVENTION

Problems to be Solved by the Invention

As described above, high elongation and low fineness are in a trade-off relationship. A fiber having both high elongation and low fineness, that is, a fiber for non-woven fabrics which has both followability with respect to complex shapes or processing with high fiber deformation stress and texture has not yet been obtained.

An object of the present invention is to provide a heat-bondable composite fiber having both high elongation and low fineness, and a manufacturing method for the heat-bondable composite fiber, which have been made against the background of the above related art. Another object of the present invention is to provide a non-woven fabric which, by using the heat-bondable composite fiber, is excellent in texture and excellent in shaping processability for following complex shapes or processing with high fiber deformation stress.

Means for Solving the Problems

In order to solve the above problems, the present inventors have made extensive research. As a result, the following has been found. By manufacturing a composite fiber including a first component containing a polyester-based resin and a second component containing a polyolefin-based resin and having a concentric sheath-core structure under appropriate drawing conditions and heat treatment conditions, a heat-bondable composite fiber having both high elongation and low fineness can be obtained. Thereby, the present invention has been completed.

That is, the present invention is configured as follows.

[1] A heat-bondable composite fiber is provided which includes a first component containing a polyester-based resin and a second component containing a polyolefin-based resin having a melting point lower than a melting point of the polyester-based resin by 15° C. or more. The heat-bondable composite fiber has a concentric sheath-core structure in which the second component occupies an outer periphery of a fiber in a cross section of the fiber orthogonal to a lengthwise direction of the fiber. The heat-bondable composite fiber has elongation at break of 350% or more and a ratio of elongation at break to fineness of 80%/dtex or more.

[2] The heat-bondable composite fiber described in [1] has a fineness of 2.0 to 6.1 dtex.

[3] The heat-bondable composite fiber described in [1] or [2] has a dry heat shrinkage of 0% to 20% at 120° C.

[4] The heat-bondable composite fiber described in any one of [1] to [3] has a web heat shrinkage of 0% to 30% at 145° C.

[5] A manufacturing method for a heat-bondable composite fiber is provided which includes processes of: melt spinning a first component containing a polyester-based resin and a second component containing a polyolefin-based resin having a melting point lower than a melting point of the polyester-based resin by 15° C. or more so as to have a concentric sheath-core cross-sectional shape in which the second component occupies an outer periphery of a fiber, and obtaining an undrawn fiber; drawing the undrawn fiber and obtaining a drawn fiber; crimping the drawn fiber; and heat-treating the crimped drawn fiber, in which drawing efficiency represented by an equation below is 40% to 75%:

Drawing efficiency (%)={fineness (dtex) of undrawn fiber/draw magnification (times)/fineness (dtex) of heat-bondable composite fiber}×100

[6] In the manufacturing method for a heat-bondable composite fiber described in [5], the process of obtaining the drawn fiber is to draw the undrawn fiber at a draw magnification of 1.5 times or more.

[7] In the manufacturing method for a heat-bondable composite fiber described in [5] or [6], the process of heat-treating is performed in a temperature range higher than a glass transition temperature of the polyester-based resin constituting the first component by 10° C. to 70° C. and lower than the melting point of the polyolefin-based resin constituting the second component.

[8] A non-woven fabric is provided which is obtained using the heat-bondable composite fiber described in any one of [1] to [4].

Effects of the Invention

Since the heat-bondable composite fiber of the present invention has both high elongation and low fineness, a non-woven fabric can be produced excellent in texture and excellent in shaping processability for following complex shapes or processing with high fiber deformation stress.

BRIEF DESCRIPTION OF THE DRAWINGS

The FIGURE is a schematic diagram showing a drawing machine used for a heat-bondable composite fiber of the present invention.

DESCRIPTION OF THE EMBODIMENTS

A heat-bondable composite fiber of the present invention is the following heat-bondable composite fiber. The heat-bondable composite fiber includes a first component containing a polyester-based resin and a second component containing a polyolefin-based resin having a melting point lower than a melting point of the polyester-based resin by 15° C. or more, and has a concentric sheath-core structure in which the second component occupies an outer periphery of a fiber in a cross section of the fiber orthogonal to a lengthwise direction of the fiber. The heat-bondable composite fiber is characterized by having elongation at break of 350% or more and a ratio of elongation at break to fineness of 80%/dtex or more. By using such a fiber, a non-woven fabric can be produced excellent in texture and excellent in shaping processability for following complex shapes or processing with high fiber deformation stress.

(First Component)

The polyester-based resin constituting the first component of the present invention is not particularly limited, and can be exemplified by: polyalkylene terephthalates, such as polyethylene terephthalate or polytrimethylene terephthalate, polypropylene terephthalate, and polybutylene terephthalate; a biodegradable polyester, such as polylactic acid, polybutylene succinate, and polyglycolic acid; and a copolymer of the foregoing and any other ester-forming component. The other ester-forming component is not particularly limited, and can be exemplified by: glycols such as diethylene glycol and polymethylene glycol, and aromatic dicarboxylic acid such as isophthalic acid and hexahydroterephthalic acid. In the case of a copolymer with the other ester-forming component, while the copolymer composition is not particularly limited, it is preferable that crystallinity is not greatly impaired. From this point of view, the content of the copolymer component is preferably 10% by mass or less, more preferably 5% by mass or less. These may be used alone, or two or more thereof may be used in combination without any problem.

Among them, considering the cost of raw materials and thermal stability of the resulting fiber, the polyester-based resin is preferably at least one selected from the group consisting of polyethylene terephthalate, polypropylene terephthalate, polybutylene terephthalate, polylactic acid, and polybutylene succinate, and is more preferably an unmodified polymer composed only of polyethylene terephthalate.

The first component is not particularly limited if it contains a polyester-based resin. The first component preferably contains 80% by mass or more of the polyester-based resin, and more preferably contains 90% by mass or more of the polyester-based resin. An additive such as an antioxidant, a light stabilizer, an ultraviolet absorber, a neutralizer, a nucleating agent, an epoxy stabilizer, a lubricant, an antibacterial agent, a flame retardant, an antistatic agent, a pigment and a plasticizer may further be appropriately added as needed within a range that does not impair the effects of the present invention.

(Second Component)

The polyolefin-based resin constituting the second component of the present invention is not particularly limited as long as a condition is satisfied that the polyolefin-based resin has a melting point lower than a melting point of the polyester-based resin constituting the first component by 15° C. or more, and the polyolefin-based resin can be exemplified by: low-density polyethylene, linear low-density polyethylene, high-density polyethylene, a maleic anhydride modified product of these ethylene-based polymers, an ethylene-propylene copolymer, an ethylene-butene-propylene copolymer, polypropylene, a maleic anhydride modified product of a propylene-based polymer, and poly-4-methylpentene-1. These may be used alone, or two or more thereof may be used in combination without any problem.

Among them, from the viewpoint of suppressing a phenomenon that polyolefin-based resins exposed on a surface of the fiber are fused together without being completely cooled and solidified during spinning, the polyolefin-based resin is preferably at least one selected from the group consisting of low-density polyethylene, linear low-density polyethylene, high-density polyethylene, and polypropylene, and is more preferably composed only of high-density polyethylene.

A melt mass-flow rate (hereinafter abbreviated as MFR) of the polyolefin-based resin that can be suitably used is not particularly limited if within a range that allows spinning. The MFR is preferably 1 to 100 g/10 min, more preferably 5 to 70 g/10 min. The physical properties of polyolefins other than the MFR, such as, for example, Q value (weight average molecular weight/number average molecular weight), Rockwell hardness, and number of branched methyl chains, are not particularly limited if they satisfy the requirements of the present invention.

The second component is not particularly limited if it contains a polyolefin-based resin. The second component preferably contains 80% by mass or more of the polyolefin-based resin, and more preferably contains 90% by mass or more of the polyolefin-based resin. The additive mentioned above by example in the first component may be appropriately included as needed within a range that does not impair the effects of the present invention.

(Heat-Bondable Composite Fiber)

The combination of the first component and the second component in the composite fiber of the present invention is not particularly limited as long as a condition is satisfied that the polyolefin-based resin constituting the second component has a melting point lower than a melting point of the polyester-based resin constituting the first component by 15° C. or more, and the first component and the second component described above can be selected and used. If the first component is a mixture of two or more polyester-based resins and/or the second component is a mixture of two or more polyolefin-based resins, the description "the polyolefin-based resin constituting the second component has a melting point lower than a melting point of the polyester-based resin constituting the first component by 15° C. or more" means that a resin having the highest melting point in the mixture of polyolefin-based resins constituting the second component has a melting point lower than a melting point of a resin having the lowest melting point in the mixture of polyester-based resins constituting the first component by 15° C. or more.

Specific combinations of the first component/second component include polyethylene terephthalate/polypropylene, polyethylene terephthalate/high-density polyethylene, polyethylene terephthalate/linear low-density polyethylene, and polyethylene terephthalate/low-density polyethylene. Among these combinations, polyethylene terephthalate/high-density polyethylene is relatively preferable.

The composite fiber of the present invention has a concentric sheath-core structure in which the second component occupies an outer periphery of a fiber in a cross section of the fiber orthogonal to a lengthwise direction of the fiber. The concentric sheath-core structure may be a concentric sheath-core solid composite fiber or a concentric sheath-core hollow composite fiber.

A cross-sectional shape of the core may include not only a circular shape but also an irregular shape. Examples of the irregular shape may include a star shape, an elliptical shape, a triangular shape, a square shape, a pentagonal shape, a polylobed shape, an arrayed shape, a T shape, and a horseshoe shape.

The composite fiber of the present invention has, in the cross section of the fiber orthogonal to the lengthwise direction thereof, a composite ratio of the first component (core component) to the second component (sheath component) of preferably 10/90 to 90/10, more preferably 30/70 to 70/30, and particularly preferably 60/40 to 50/50 in terms of volume fraction. The composite ratio affects elongation of an undrawn fiber and adhesive strength of the fiber when the fiber is processed into a non-woven fabric. By increasing the ratio of the first component, the elongation of the undrawn fiber can be suitably left, and the elongation of a drawn fiber obtained by a drawing process can be increased. Thus, shaping processability of the non-woven fabric can be suitably obtained. By increasing the ratio of the second component, the adhesive strength of the fiber when the fiber is processed into a non-woven fabric can be improved, and a non-woven fabric that hardly breaks can be suitably obtained.

Fineness of the composite fiber of the present invention, while not particularly limited, is preferably 2.0 to 6.1 dtex. Specifically, for a fiber that may be used in a sanitary material, the fineness is more preferably 2.6 to 5.5 dtex, and even more preferably 3.5 to 4.5 dtex. The fineness of the composite fiber is preferably 2.0 dtex or more because a composite fiber having high elongation can be easily obtained. The fineness of the composite fiber is preferably 6.1 dtex or less because a non-woven fabric having good texture can be obtained. By setting the fineness within such a range, it is possible to achieve both high elongation and low fineness, and it is easy to achieve excellent texture and both good texture and followability in shaping processing when the non-woven fabric is processed.

Elongation at break of the composite fiber of the present invention is 350% or more, preferably 400% or more, and more preferably 500% or more. By setting the elongation at break of the composite fiber to 350% or more, the fiber can be stretched without being cut in a state of being made into a non-woven fabric, and a non-woven fabric can be obtained excellent in shaping processability for following complex shapes. An upper limit of the elongation at break, while not particularly limited, is practically 700% or less.

The elongation at break referred to in the present invention is defined as follows. A tensile test is conducted in accordance with JIS L 1015 using a tensile tester with a sample grip interval of 20 mm, and elongation at the time of breaking is taken as the elongation at break of the fiber.

A ratio of elongation at break to fineness of the composite fiber of the present invention is 80%/dtex or more, preferably 90%/dtex or more, more preferably 105%/dtex or more, and particularly preferably 130%/dtex or more. If the ratio of elongation at break to fineness of the composite fiber is 80%/dtex or more, it is possible to obtain a non-woven fabric having a good balance between shaping processability and texture. If the ratio is 105%/dtex or more, it is possible to obtain a non-woven fabric having an excellent balance between shaping processability and texture. If the ratio is 130%/dtex or more, it is possible to obtain a non-woven fabric having both shaping processability and texture at a high level.

Breaking strength of the composite fiber of the present invention is not particularly limited. For example, for a fiber that may be used in a sanitary material, the breaking strength is preferably in a range of 0.5 to 1.5 cN/dtex, more preferably in a range of 0.7 to 1.0 cN/dtex. If the breaking strength is low, there is a possibility that the fiber may break or get entangled when the fiber is transported in a manufacturing process. If the breaking strength of the composite fiber is 0.5 cN/dtex or more, the strength is sufficient, and fiber breakage or entanglement can be suppressed. Since the breaking strength is generally inversely proportional to the elongation, if the breaking strength is 1.5 cN/dtex or less, sufficient elongation can be left for processing when the fiber is made into a non-woven fabric. By setting the breaking strength within such a range, a fiber can be obtained that does not cause troubles in each process while maintaining elongation.

A ratio (breaking strength [cN/dtex])/elongation at break [%]) of breaking strength to elongation at break of the composite fiber of the present invention, while not particularly limited, is preferably less than 0.005, more preferably less than 0.0024. A large ratio of breaking strength to elongation at break means high strength and low elongation, and a small ratio of breaking strength to elongation at break means low strength and high elongation. When a non-woven fabric using the fiber undergoes shaping processing, the fiber in the non-woven fabric suitably follows the processing. If this ratio is less than 0.005, when the non-woven fabric undergoes shaping processing, smooth processing is possible without causing single yarn breakage. If the ratio is less than 0.0024, processing followability at a relatively high level can be obtained, which is preferable.

A dry heat shrinkage of the composite fiber of the present invention at 120° C., while not particularly limited, is preferably 0% to 20%, more preferably 0% to 10%, and even more preferably 0% to 5%. The dry heat shrinkage is preferably 0% or more because the elongation of the fiber is improved as shrinkage occurs. The dry heat shrinkage is preferably 20% or less because thermal dimensional stability when a web using the composite fiber of the present invention is heat-treated and processed into a non-woven fabric can be ensured. By setting a heat shrinkage within such a range, it is possible to achieve both shaping followability and thermal dimensional stability at a sufficient level. A method for calculating the dry heat shrinkage will be described later in Examples.

A web heat shrinkage at 145° C. when the composite fiber of the present invention is made into a web sheet, while not particularly limited, is preferably 0% to 30%, more preferably 0% to 8%, and even more preferably 0% to 5%. The web heat shrinkage is preferably 0% or more because the elongation of the fiber is improved as shrinkage occurs, and the shaping followability when the non-woven fabric undergoes shaping processing is improved. On the other hand, from the viewpoint of thermal dimensional stability when the non-woven fabric is heat-treated, the web heat shrinkage is preferably 30% or less. By setting the web heat shrinkage within such a range, it is possible to achieve both thermal dimensional stability and shaping followability of the non-woven fabric. A method for calculating the web heat shrinkage will be described later in Examples.

Number of crimp of the composite fiber of the present invention, while not particularly limited, is preferably 9 to 20 peaks/2.54 cm, more preferably 11 to 18 peaks/2.54 cm. If the number of crimp is 9 peaks/2.54 cm or more, card passability is at a sufficient level. If the number of crimp is 11 peaks/2.54 cm or more, relatively suitable card passability can be obtained. If the number of crimp is 20 peaks/2.54 cm or less, the occurrence of neps when a web is formed can be suppressed. If the number of crimp is 18 peaks/2.54 cm or less, the occurrence of neps can be relatively suitably suppressed.

A crimp ratio of the composite fiber of the present invention, while not particularly limited, is preferably 5% to 15%, more preferably 6% to 12%. If the crimp ratio is 5% or more, card passability is at a sufficient level. If the crimp ratio is 6% or more, relatively suitable card passability can be obtained. If the crimp ratio is 15% or less, uniform texture when a web is formed can be obtained. If the crimp ratio is 12% or less, relatively suitably uniform texture can be obtained, which is thus preferable.

A crimp elastic modulus of the composite fiber of the present invention, while not particularly limited, is preferably 85% to 100%. By setting the crimp elastic modulus to 85% or more, morphological stability of crimp can be maintained in a process of making a non-woven fabric, whereby the card passability in the process of obtaining the non-woven fabric is improved.

In the composite fiber of the present invention, in order to obtain a fiber that provides a drape feeling derived from self-weight or a smooth tactile feel and is excellent in flexibility by formation of gaps such as voids or cracks inside and outside the fiber, inorganic fine particles may be appropriately added as needed within a range that does not impair the effects of the present invention. The amount of the inorganic fine particles added is preferably 0% to 10% by mass, more preferably 0.1% to 10% by mass, and even more preferably 1% to 5% by mass in the fiber.

The inorganic fine particles are not particularly limited if they have a high specific gravity and hardly aggregate in molten resin. For example, titanium oxide (having a specific gravity of 3.7 to 4.3), zinc oxide (having a specific gravity of 5.2 to 5.7), barium titanate (having a specific gravity of 5.5 to 5.6), barium carbonate (having a specific gravity of 4.3 to 4.4), barium sulfate (having a specific gravity of 4.2 to 4.6), zirconium oxide (having a specific gravity of 5.5), zirconium silicate (having a specific gravity of 4.7), alumina (having a specific gravity of 3.7 to 3.9), magnesium oxide (having a specific gravity of 3.2) or a substance having a specific gravity almost equivalent to that of the foregoing may be used. Among them, titanium oxide is preferably used. It is generally known that these inorganic fine particles are added to a fiber for purposes such as hiding properties, antibacterial properties, or deodorant properties. The inorganic fine particles used preferably have a particle size or a shape in which no problems such as yarn breakage are caused in a spinning process or drawing process.

Examples of a method for adding the inorganic fine particles may include a method in which powder of the inorganic fine particles is directly added to the first component or the second component, or a method in which the inorganic fine particles are kneaded into a resin to form a masterbatch, and the masterbatch is added to the first component or the second component. The resin used for masterbatching is most preferably the same resin as the first and second components. However, the resin is not particularly limited if it satisfies the requirements of the present invention, and a resin different from the first and second components may be used.

(Manufacturing Method for Composite Fiber)

A manufacturing method for the composite fiber of the present invention includes: a process (hereinafter sometimes referred to as spinning process) of melt spinning a first component containing a polyester-based resin and a second component containing a polyolefin-based resin having a melting point lower than a melting point of the polyester-based resin by 15° C. or more so as to have a concentric sheath-core cross-sectional shape in which the second component occupies an outer periphery of a fiber, and obtaining an undrawn fiber; a process (hereinafter sometimes referred to as drawing process) of drawing the undrawn fiber under a specific condition and obtaining a drawn fiber; a process (hereinafter sometimes referred to as crimping process) of crimping the drawn fiber; and a process (hereinafter sometimes referred to as heat treatment process) of heat-treating the crimped drawn fiber. At that time, the manufacturing can be performed by adjusting drawing efficiency represented by an equation below to be in a range of 40% to 75%.

Drawing efficiency (%)={fineness (dtex) of undrawn fiber/draw magnification (times)/fineness (dtex) of heat-bondable composite fiber}×100

Conventionally, it has been known that a fiber having relatively high elongation can be obtained by drawing (flow drawing) an undrawn polyester-based fiber at a temperature higher than a glass transition point. However, the fiber has poor card passability due to its low rigidity and low shape stability of crimp, and further has large thermal shrinkage and low thermal dimensional stability. However, the present inventors have found that, by further heat-treating a composite fiber after flow drawing, the elongation is further increased, and the card passability and the thermal dimensional stability are significantly improved. Without being bound by any particular theory, it is considered that the reason is as follows. By the heat treatment after flow drawing, the polyester-based resin constituting the first component changes from a state of low crystallinity and high orientation to high elongation and low shrinkage due to orientational relaxation by heat, and the rigidity of the fiber is improved by further oriented crystallization of the polyolefin-based resin constituting the second component. This effect is believed to be based on a phenomenon that the heat treatment after flow drawing increases the fineness and shrinks the fiber in the lengthwise direction. For example, the fineness of the drawn fiber after the heat treatment is 120% or more, preferably 130% or more, and more preferably 140% or more of the fineness of the drawn fiber before the heat treatment. An upper limit thereof is not particularly limited and is practically 200% or less. A length of the drawn fiber after the heat treatment is 90% or less, preferably 85% or less, and more preferably 80% or less of the length of the drawn fiber before the heat treatment. A lower limit thereof is not particularly limited and is practically 50% or more. That is, a composite fiber obtained by setting the drawing efficiency to 40% to 75%, more preferably 50% to 70%, and even more preferably 55% to 66% has both high elongation and low fineness. Furthermore, since the composite fiber has good card passability and excellent thermal dimensional stability, a non-woven fabric can be easily produced excellent in texture and excellent in shaping processability for following complex shapes or processing with high fiber deformation stress. The effects described as above were not expected in the related art, and are novel effects found in the present invention.

It is possible to control the drawing efficiency by appropriately selecting a spinning temperature, a spinning speed, a draw magnification, a drawing temperature, a heat treatment temperature or the like, which will be described later.

(Spinning Process)

In the spinning process, the first component and the second component are each melt spun using a known concentric sheath-core spinning nozzle so as to have a concentric sheath-core cross-sectional shape, thereby obtaining an undrawn fiber. A temperature (hereinafter sometimes referred to as spinning temperature) during melt spinning is not particularly limited as long as it is a temperature at which the first component and the second component can be melted. The spinning temperature is preferably equal to or higher than a melting point of the first component, more preferably higher than the melting point of the first component by 30° C. or more, and even more preferably higher than the melting point of the first component by 50° C. or more. The spinning temperature is preferably higher than the melting point of the first component by 30° C. or more, since the number of times of yarn breakage during spinning can be reduced, and an undrawn yarn that tends to retain elongation after drawing can be obtained. The spinning temperature is preferably higher than the melting point of the first component by 50° C. or more, since the above effects become relatively pronounced. An upper limit of the temperature is not particularly limited if it is a temperature at which spinning can be suitably performed. The spinning speed is not particularly limited if within a range in which an undrawn fiber can be obtained. The spinning speed is preferably 300 to 1500 m/min, more preferably 550 to 1000 m/min. The spinning speed is preferably 300 m/min or more, since a single hole discharge rate during an attempt to obtain an undrawn fiber having arbitrary fineness can be increased and satisfactory productivity can be obtained.

The fineness of the undrawn fiber, while not particularly limited, is preferably 5 to 12 dtex, more preferably 6 to 11 dtex, and even more preferably 7 to 10 dtex. If the fineness of the undrawn fiber is 5 dtex or more, sufficient elongation can be ensured in the drawn fiber, and shaping processability when the fiber is processed into a non-woven fabric can be suitably obtained. If the fineness of the undrawn fiber is 12 dtex or less, the fineness of the drawn fiber can be made sufficiently low. When the fiber is processed into a non-woven fabric, sufficient texture can be ensured, which is thus preferable. By setting the fineness within such a range, it is possible to achieve both shaping processability and texture of the non-woven fabric.

(Drawing Process)

The undrawn fiber obtained under the above conditions is drawn in the drawing process. In the drawing process, by changing a temperature or a draw magnification and controlling orientation or crystallinity of a molecular chain of the first component and/or the second component, physical properties such as strength, elongation and heat resistance of the composite fiber can be controlled.

The draw magnification in the drawing process of the present invention, while not particularly limited, is preferably 1.5 times or more, more preferably in a range of 2 to 5 times, and even more preferably in a range of 2.5 to 4 times. The draw magnification is preferably 1.5 times or more because the fineness can be reduced, and is preferably 5 times or less because the elongation can be increased. The drawing temperature, while not particularly limited, is preferably in a temperature range higher than the glass transition temperature of the polyester-based resin constituting the first component by 10° C. to 70° C. and lower than the melting point of the polyolefin-based resin constituting the second component, more preferably in a temperature range higher than the glass transition temperature of the polyester-based resin constituting the first component by 35° C. to 60° C. and lower than the melting point of the polyolefin-based resin constituting the second component by 5° C. or more, and even more preferably in a temperature range higher than the glass transition temperature of the polyester-based resin constituting the first component by 40° C. to 50° C. and lower than the melting point of the polyolefin-based resin constituting the second component by 10° C. or more. If the drawing temperature is higher than the glass transition temperature of the polyester-based resin constituting the first component by 10° C. or more, more preferably by 35° C. or more, and even more preferably by 40° C. or more, a fiber having high elongation can be obtained even if it is drawn at a high ratio, which is thus preferable. If the drawing temperature is higher than the glass transition temperature of the polyester-based resin constituting the first component by 70° C. or less, more preferably 60° C. or less, and even more preferably 50° C. or less, destabilization of the drawing process due to fusion between the polyolefin-based resins being the second component can be suppressed, which is thus preferable.

The drawing process of the present invention is not particularly limited within a range that does not impair the effects of the present invention, and may be one-stage drawing, or two-stage drawing in which a fiber once subjected to drawing is subjected to drawing again, or multi-stage drawing in which the same procedure as above is repeated. In the case of performing drawing twice or more times, the drawing may be continuously performed.

The one-stage drawing and the two-stage drawing will be described in more detail below with reference to the FIGURE. However, the present invention is not limited thereto.

As shown in (a) of the FIGURE, the one-stage drawing is performed by a drawing machine 10 including a first draw frame 11 that includes a plurality of rolls and a second draw frame 12 that includes a plurality of rolls. Specifically, a speed of a fiber pulled by the second draw frame 12 is made greater than a speed of the fiber sent out by the first draw frame 11, and a fiber F is drawn by being pulled by the second draw frame 12. By controlling orientation or crystallinity of a molecular chain by drawing in this way, the physical properties such as strength, elongation and heat resistance of the composite fiber can be controlled. A steam chamber 13 may be provided between the first draw frame 11 and the second draw frame 12.

In the drawing machine 10 of (a) of the FIGURE like this, a draw magnification of the fiber F is expressed as $X_2/X_1$ in which drawing is performed at a speed of the first draw frame 11 defined as $X_1$ and a speed of the second draw frame 12 defined as $X_2$. The drawing temperature means a temperature of the fiber at a drawing start position. That is, the drawing temperature means the temperature of the fiber in the first draw frame 11 in the drawing machine 10.

As shown in (b) of the FIGURE, the two-stage drawing is performed by a drawing machine 20 including a first draw frame 21, a second draw frame 22 that includes a plurality of rolls, and a third draw frame 23 that includes a plurality of rolls. Specifically, drawing is performed by making the speed $X_2$ of the fiber pulled by the second draw frame 22 greater than the speed $X_1$ of the fiber sent out by the first draw frame 21, and further by making a speed $X_3$ of the fiber pulled by the third draw frame 23 greater than the speed $X_2$ of the fiber sent out by the second draw frame 22. That is, first drawing is performed between the first draw frame 21 and the second draw frame 22, and second drawing is further performed between the second draw frame 22 and the third draw frame 23. The sign 24 denotes a steam chamber. For example, two drawing machines 10 of (a) of the FIGURE may be independently arranged and drawing may be performed twice.

The draw magnification in each time is defined as follows. In the case where drawing is performed at a speed of Xn of the fiber by an upstream draw frame and a speed of Xn+1 of the fiber by a downstream draw frame, the draw magnification of the fiber is expressed as Xn+1/Xn. An overall draw magnification in the two-stage drawing is expressed by the product of the draw magnification in the first time and the draw magnification in the second time. The drawing temperature means the temperature of the fiber at the initial drawing start position. That is, the drawing temperature means the temperature of the fiber in the first draw frame 21 in the drawing machine 20.

(Crimping Process)

Next, in the crimping process, the drawn fiber is mechanically crimped by a crimper or the like. Card passability can be improved by crimping the drawn fiber. Such mechanical crimp has a two-dimensional crimp shape such as a planar zigzag structure (bent shape).

The number of crimp applied in the crimping process, while not particularly limited, is preferably 9 to 20 peaks/2.54 cm. The number of crimp can be adjusted, for example, by appropriately changing a stuffing box pressure in a push-in type crimper.

(Heat Treatment Process)

Next, the crimped drawn fiber is heat-treated, the orientation of the polyester-based resin constituting the first component is relaxed, the elongation of the composite fiber is increased, a heat shrinkage is reduced, a degree of crystallinity of the polyolefin-based resin constituting the second component is increased, and a fiber with good card passability is obtained.

The heat treatment process of the present invention is not particularly limited, and may be a heat treatment using heated air or steam, or a heat treatment by contact with a hot roll or the like. The heat treatment may be performed in a state in which the fiber is constrained to a fixed length, or in a state in which the fiber is relaxed. The heat treatment temperature, while not particularly limited, is preferably in a temperature range higher than the glass transition temperature of the polyester-based resin constituting the first component by 10° C. to 70° C. and lower than the melting point of the polyolefin-based resin constituting the second component, more preferably in a temperature range higher than the glass transition temperature of the polyester-based resin constituting the first component by 30° C. to 60° C. and lower than the melting point of the polyolefin-based resin constituting the second component by 5° C. or more. If the heat treatment temperature is higher than the glass transition temperature of the polyester-based resin constituting the first component by 10° C. or more, preferably by 30° C. or more, not only a fiber having high elongation can be obtained but also heat shrinkage can be suppressed and adjustment of physical properties of the non-woven fabric can be facilitated, which is thus preferable. If the heat treatment temperature is higher than the glass transition temperature of the polyester-based resin constituting the first component by 70° C. or less, preferably by 60° C. or less, destabilization of the drawing process due to fusion between the polyolefin-based resins being the second component can be suppressed, which is thus preferable. The heat treatment temperature is preferably higher than the drawing temperature. Furthermore, a time of the heat treatment, while not particularly limited, is preferably long within a range that does not impair operability. The time is specifically 5 seconds or longer, more preferably 30 seconds or longer, and even more preferably 3 minutes or longer.

(Attachment Process of Fiber Treatment Agent)

The composite fiber of the present invention may have its surface treated with various fiber treatment agents, whereby functions such as hydrophilicity, water repellency, antistatic properties, surface smoothness and wear resistance can be imparted.

A process of attaching the fiber treatment agent may be performed by methods including, for example, attaching the fiber treatment agent with a kiss roll during collection of an undrawn fiber, or attaching the fiber treatment agent during and/or after drawing by a touch roll method, a dipping method, a spraying method, or the like.

(Cutting Process)

The heat-treated composite fiber may be cut into short fibers. A cut length can be selected according to the application and is not particularly limited. If carding is to be performed, the cut length is preferably in a range of 20 to 102 mm, more preferably in a range of 30 to 51 mm.

(Non-Woven Fabric)

Since the non-woven fabric of the present invention uses a composite fiber having both high elongation and low fineness, the non-woven fabric is excellent in texture and in shaping processability for following complex shapes or processing with high fiber deformation stress. Processing conditions for the non-woven fabric are not particularly limited. For example, a method may be mentioned in which a carded web obtained using a roller carder is heat-treated at a temperature equal to or higher than the melting point of the second component to obtain a non-woven fabric. The heat treatment method is not particularly limited, and is preferably a through-air processing method or the like in which flexibility of the non-woven fabric can be satisfactorily processed.

A non-woven fabric manufactured using the composite fiber of the present invention can be used for various fiber products that require bulkiness or flexibility, such as, for example: absorbent articles, such as diapers, napkins, and incontinence pads; medical sanitary materials, such as gowns and surgical gowns; interior materials, such as wall sheets, shoji paper, and flooring; life-related materials, such as cover cloths, cleaning wipers, and garbage covers; toiletry products, such as disposable toilets and toilet covers; pet products, such as pet sheets, pet diapers, and pet towels; industrial materials, such as wiping materials, filters, cushion materials, oil adsorbents, and ink tank adsorbents; general medical materials; bedding materials; and nursing care products.

EXAMPLES

The present invention will be described below with reference to Examples, but the present invention is not limited to these Examples. Physical property evaluations in each example were performed by methods shown below.

<MFR of Polyolefin-Based Resin>

A measurement was performed in accordance with JIS K 7210.

<Fineness, Breaking Strength, Elongation at Break, Ratio of Elongation at Break to Fineness>

Fineness of an undrawn fiber, fineness of a composite fiber, breaking strength, and elongation at break were measured in accordance with JIS L 1015. A ratio of elongation at break to fineness was calculated by dividing the elongation at break [%] by the fineness [dtex].

<Dry Heat Shrinkage>

A shrinkable fiber was cut out to have a length of about 500 mm, heat-treated in a circulation oven at 120° C. for 5 minutes, and a dry heat shrinkage was calculated according to an equation below.

$$\text{Dry heat shrinkage (\%)} = (\text{fiber length before heat treatment} - \text{fiber length after heat treatment})/\text{fiber length before heat treatment} \times 100$$

<Web Heat Shrinkage>

A heat-bondable composite fiber was applied to a roller carder. A web sheet having a basis weight of about 200 g/m$^2$ was picked, cut out in a square of about 25 cm, and a length A0 of the fiber in a machine direction was measured. The web sheet was left in a hot air circulating dryer heated to 145° C. for 5 minutes for heat treatment, a length A1 of the fiber in the machine direction of the sheet after a shrinkage treatment was measured, a web heat shrinkage was calculated according to an equation below.

$$\text{Web heat shrinkage (\%)} = [(A0-A1)/A0] \times 100$$

<Fuzz and Tactile Feel Evaluation>

A heat-bondable composite fiber was applied to a roller carder. A thus obtained web was heat-treated to obtain a non-woven fabric, and the non-woven fabric was cut out in a size of 15 cm×5 cm with the machine direction as the long side. The cut-out non-woven fabric sample was subjected to drawing by Autograph AGS-J manufactured by Shimadzu Corporation. Drawing to 15 cm was performed with a sample length of 10 cm at a tensile speed of 100 m/min, and a sample for texture evaluation was produced. Texture of the obtained sample was evaluated in the following four stages.

[Evaluation Criteria]

◎: There was no fuzz on the surface of the non-woven fabric, and a very good tactile feel was provided.

○: There was no fuzz on the surface of the non-woven fabric, and a good tactile feel was provided.

Δ: There was fuzz on the surface of the non-woven fabric, or a poor tactile feel was provided.

x: There was fuzz on the surface of the non-woven fabric, and a poor tactile feel was provided.

<Followability Evaluation>

A sample for followability evaluation was produced in the same manner as in the above texture evaluation. Followability of the obtained sample was evaluated in the following four stages.

[Evaluation Criteria]

◎: The non-woven fabric was drawn as a whole, and no partial breakage of the non-woven fabric was observed.

○: The non-woven fabric was locally drawn, and no partial breakage of the non-woven fabric was observed.

Δ: Partial breakage of fibers in the non-woven fabric was observed.

x: The non-woven fabric was broken by drawing.

Examples 1 to 5 and Comparative Examples 1 to 3

<Manufacturing of Heat-bondable Composite Fiber>

Polyethylene terephthalate (abbreviation: PET) having an intrinsic density of 0.64, a glass transition temperature of 70° C. and a melting point of 255° C. was arranged on the core side, high-density polyethylene (abbreviation: PE) having a density of 0.96 g/cm$^3$, an MFR (under a load of 21.18N at 190° C.) of 16 g/10 min, and a melting point of 130° C. was arranged on the sheath side, and the above were combined in a cross-sectional form of a first component (core)/a second component (sheath)=60/40 (volume fraction) using a concentric sheath-core nozzle at a spinning speed of 600 m/min to obtain an undrawn fiber of 8.0 dtex. Next, the obtained undrawn fiber was subjected to drawing, mechanical crimping, and heat treatment under the conditions shown in Table 1 to obtain a heat-bondable composite fiber. Table 2 shows physical properties of composite fibers obtained in Examples 1 to 5 and Comparative Examples 1 to 3.

TABLE 1

| | Drawing conditions | | | Mechanical crimping | Heat treatment conditions | | | Ratio (%) of fineness after heat | |
|---|---|---|---|---|---|---|---|---|---|
| | Draw magnification (times) | Drawing temperature (° C.) relative to glass transition point of first component | Fineness (dtex) after drawing | Presence or absence of mechanical crimp | Heat treatment method | Heat treatment temperature (° C.) | Heat treatment time (min) | treatment to fineness before heat treatment | Drawing efficiency (%) |
| Example 1 | 3.2 | +40 | 2.6 | Present | Hot air circulation | 115 | 5 | 146 | 66 |
| Example 2 | 2.8 | +40 | 2.9 | Present | Hot air circulation | 123 | 5 | 152 | 65 |
| Example 3 | 2.6 | +40 | 3.3 | Present | Hot air circulation | 123 | 5 | 152 | 62 |
| Example 4 | 2.0 | +40 | 4.1 | Present | Hot air circulation | 115 | 5 | 149 | 66 |
| Example 5 | 3.2 | +40 | 2.6 | Present | Hot air circulation | 90 | 5 | 138 | 69 |
| Comparative Example 1 | 3.2 | +20 | 2.7 | Present | Hot air circulation | 115 | 5 | 119 | 78 |
| Comparative Example 2 | 1.3 | +20 | 6.4 | Present | Hot air circulation | 115 | 5 | 100 | 96 |
| Comparative Example 3 | 2.0 | +40 | 4.1 | Present | None | None | None | 100 | 98 |

TABLE 2

| | Fineness (dtex) | Breaking strength (cN/dtex) | Elongation at break (%) | Ratio of elongation at break to fineness (%/dtex) | Dry heat shrinkage (%) | Web heat shrinkage (%) | Fuzz and tactile feel | Followability |
|---|---|---|---|---|---|---|---|---|
| Example 1 | 3.8 | 1.0 | 503 | 132 | 2 | 3 | ◎ | ◎ |
| Example 2 | 4.4 | 0.8 | 386 | 88 | 2 | 3 | ◎ | ○ |
| Example 3 | 5.0 | 0.7 | 423 | 85 | 2 | 3 | ◎ | ○ |
| Example 4 | 6.1 | 0.6 | 597 | 98 | 3 | 1 | ○ | ◎ |
| Example 5 | 3.6 | 0.9 | 522 | 145 | 18 | 30 | ◎ | ◎ |
| Comparative Example 1 | 3.2 | 2.6 | 168 | 53 | 3 | 3 | X | X |
| Comparative Example 2 | 6.4 | 1.1 | 399 | 62 | 1 | −0.5 | Δ | ○ |
| Comparative Example 3 | 4.1 | 0.9 | 312 | 76 | 22 | 40 | Δ | Δ |

As shown by the above results, since Examples 1 to 4 according to the present invention had high elongation at break of 386% to 597% and a high ratio of elongation at break to fineness of 88%/dtex to 132%/dtex, a non-woven fabric produced by such a composite fiber was excellent in texture and followability. A shrinkage due to heat was small, and it was easy to control a basis weight or width. Example 5 had low fineness and high elongation, and was satisfactory in terms of texture and followability of the non-woven fabric. However, the shrinkage due to heat was somewhat large, and it was somewhat difficult to control the basis weight or width.

The composite fibers of Comparative Examples 1 and 3 had elongation at break of less than 350%, and the non-woven fabric had small elongation and poor followability.

The composite fibers of Comparative Examples 1 to 3 had a small ratio of elongation at break to fineness, and was not satisfactory in terms of the balance between texture and followability of the non-woven fabric.

INDUSTRIAL APPLICABILITY

The heat-bondable composite fiber of the present invention has both high elongation and low fineness, thereby enabling production of a non-woven fabric excellent in texture and excellent in shapeability for following complex shapes or processing with high fiber deformation stress. By taking advantage of such a characteristic, the heat-bondable composite fiber can be suitably used for absorbent articles for sanitary materials such as diapers, napkins and pads, medical sanitary materials, life-related materials, general medical materials, bedding materials, filter materials, nursing care products, and pet products.

The invention claimed is:

1. A heat-bondable composite fiber, comprising a first component containing a polyester-based resin and a second component containing a polyolefin-based resin having a melting point lower than a melting point of the polyester-based resin by 15° C. or more, the heat-bondable composite fiber having a concentric sheath-core structure in which the second component occupies an outer periphery of a fiber in a cross section of the fiber orthogonal to a lengthwise direction of the fiber, wherein the heat-bondable composite fiber has elongation at break of 400% or more, a ratio of elongation at break to fineness of 105%/dtex or more, a dry heat shrinkage of 0% to 20% at 120° C., and a breaking strength of 0.5 to 1.5 cN/dtex, and a composite ratio of the first component to the second component is 60/40 to 50/50 in terms of volume fraction.

2. The heat-bondable composite fiber according to claim 1, having a fineness of 2.0 to 6.1 dtex.

3. A non-woven fabric obtained by using the heat-bondable composite fiber according to claim 1.

* * * * *